US005325763A

United States Patent [19]

Foster

[11] Patent Number: 5,325,763

[45] Date of Patent: Jul. 5, 1994

[54] INTERNAL CHECK VALVE

[76] Inventor: Raymond K. Foster, P.O. Box 1, Madras, Oreg. 97741

[21] Appl. No.: 54,530

[22] Filed: Apr. 28, 1993

[51] Int. Cl.[5] ..... F15B 11/20

[52] U.S. Cl. ..... 91/422; 91/189 R; 91/468; 92/113

[58] Field of Search ..... 91/176, 189 R, 189 A, 91/468, 422; 92/111, 113, 114, 117 R, 117 A

[56] References Cited

U.S. PATENT DOCUMENTS

| | | | |
|---|---|---|---|
| 3,871,265 | 3/1975 | Koga et al. | 91/189 R |
| 4,748,893 | 6/1988 | Foster | 91/176 |
| 5,103,866 | 4/1992 | Foster | 137/596.15 |
| 5,125,502 | 6/1992 | Foster | 198/750 |
| 5,193,661 | 3/1993 | Foster | 198/750 |

FOREIGN PATENT DOCUMENTS

| | | | |
|---|---|---|---|
| 163707 | 10/1982 | Japan | 91/189 R |
| 184303 | 10/1983 | Japan | 91/189 R |

*Primary Examiner*—Edward K. Look
*Assistant Examiner*—F. Daniel Lopez
*Attorney, Agent, or Firm*—Glenn D. Bellamy; David P. Campbell; Joan H. Pauly

[57] ABSTRACT

An internal check valve for use in a linear hydraulic motor in the form of a piston-cylinder unit including a cylinder body (38) reciprocally slidable on a piston component (40). The piston component (40) includes a tubular piston rod (52) and a piston head (60) defining first and second working chambers (136, 140) within the cylinder body (38). The tubular piston rod (52) includes a center tube (102) located within the piston rod (52). The center tube (102) provides a fluid passageway (134) through its center which communicates with a first working chamber (136). An annular second passageway (142) is formed by and radially between the piston rod (52) and the center tube (102). A spring biased check valve (116) is positioned within the piston rod (52, 54) and is operatively connected with one of the passageways (134, 126, 130). The check valve (116) has a valve member displaceable from a valve seat (120) by hydraulic pressure to overcome the spring bias (122, 124) and allow flow in one direction. The center tube (102) is axially displaceable relative to the piston rod (52). Displacement is effected by end of stroke movement of the cylinder body (38) and displacement of the center tube (102) causes displacement of the valve member (116) to mechanically open the check valve.

23 Claims, 5 Drawing Sheets

INTERNAL CHECK VALVE

TECHNICAL FIELD

The present invention relates to an internal check valve for a linear hydraulic motor. More particularly, it relates to the provision of a check valve which may be mechanically displaced at the end of stroke in one direction.

BACKGROUND OF THE INVENTION

It is well known that linear hydraulic motors can be sequentially or otherwise controlled by check valves which are displaced by end of stroke movement. Typically, such check valves are mounted externally and are actuated by a dog or actuation member extending from either the piston, the cylinder, or some member which is moved as a result of movement of either the piston or cylinder. Externally-located check valves of this type are exposed to hazards and adverse environmental conditions. External connections between such check valves are also subject to damage and multiply the opportunity for leakage and failure.

SUMMARY OF THE INVENTION

The present invention provides a check valve which is positionable internally of a linear hydraulic motor. A piston-cylinder unit includes a cylinder body reciprocally slidable on a piston component. The piston component includes a tubular piston rod and a piston head defining first and second working chambers within the cylinder body. The tubular piston rod includes a center tube located within the piston rod. The center tube provides a fluid passageway through its center which communicates with a first working chamber and an annular second passageway is formed by and radially between the piston rod and the center tube. A spring biased check valve is positioned within the piston rod and operatively connected with one of the passageways. The check valve has a valve member displaceable from a valve seat by hydraulic pressure to overcome the spring bias and allow flow in one direction. The center tube is axially displaceable relative to the piston rod. Displacement is effected by end of stroke movement of the cylinder body and such displacement of the center tube causes displacement of the valve member to mechanically open the check valve.

Other aspects, features and advantages of the present invention are seen in the following description of the best mode of carrying out the invention, claims and attached drawings, all of which are incorporated herein as a disclosure of the present invention.

BRIEF DESCRIPTION OF THE DRAWINGS

Like reference numerals are used to designate like parts throughout the several views of the drawing, and.

BEST MODE FOR CARRYING OUT THE INVENTION

Figure 1:
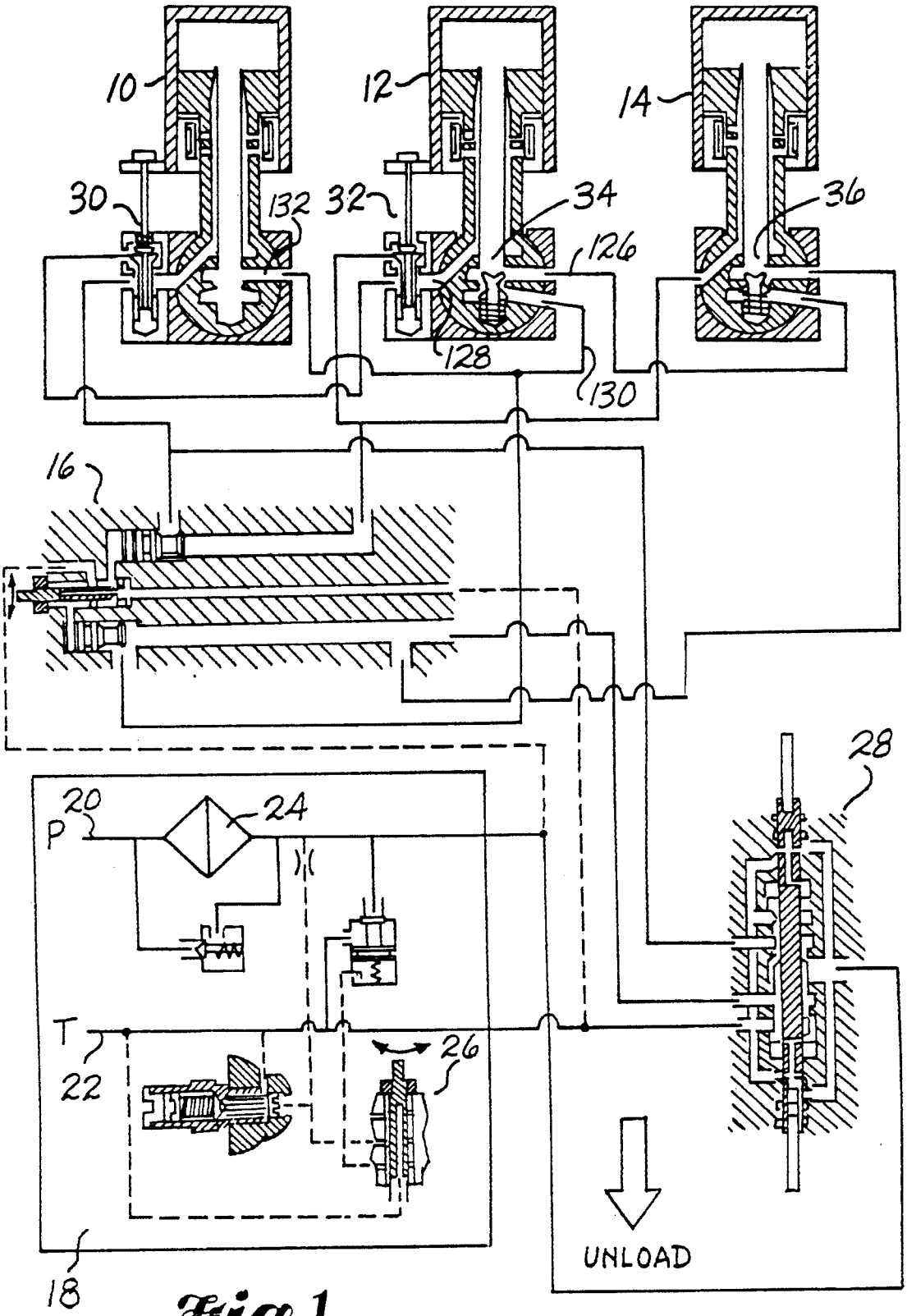
FIG. 1 is a schematic diagram of three linear hydraulic motors and a control system for automatically controlling hydraulic fluid pressure to and from the working chambers of the motors.

FIG. 1 shows a system of linear hydraulic motors that is similar to the system shown in my U.S. Pat. No. 5,193,661, granted Mar. 16, 1993. Like the system disclosed in U.S. Pat. No. 5,193,661, the system of FIG. 1 is designed for controlling the floor slats of a reciprocating floor conveyor. In operation, all three piston-cylinder units (also herein referred to as "drive units") 10, 12, 14 are retracted in unison to convey a load. Then, they are extended, one at a time, for returning the floor slats to a start position, one-third of the slats at a time. This sequence is described in my U.S. Pat. No. 5,193,661, and also in my U.S. Pat. No. 5,125,502, granted Jun. 30, 1992, and in my U.S. Pat. No. 4,748,893, granted Jun. 7, 1988.

Referring to FIG. 1, element 16 is a directional control valve. This valve 16 has two positions. In one position, valve 16 directs the drive units 10, 12, 14 to unload a load. For example, if the conveyor is in a trailer, the drive units 10, 12, 14 would move the floor slat members in unison towards the rear of the trailer, to unload the cargo in the trailer. When valve 16 is in its second position, it directs drive units 10, 12, 14 to load the trailer. The drive units 10, 12, 14 are moved in unison towards the front end of the trailer, to move the load towards the front end of the trailer. Valve 16 forms the subject matter of my copending application Ser. No. 08/054,534, filed on even date herewith, and entitled "Directional Control Valve."

Assembly 18 includes a port 20 connected to a pump or other source of hydraulic oil pressure and a port 22 connected to return or tank. It preferably also includes a filter 24, an on-off valve 26 and other valving which protects the system from inadvertent misconnection of port 22 to the pump and port 20 to the tank. Assembly 18 forms the subject matter of my copending application Ser. No. 08/054,532 filed on even date herewith, and entitled "Protective Connection to Pressure and Return."

Valve 28 is a switching valve. This valve is disclosed in my U.S. Pat. No. 5,103,866, granted Apr. 14, 1992, and entitled "Poppet Valve and Valve Assemblies Utilizing Same." Valve 28 is also disclosed and described in my U.S. Pat. No. 5,125,502, granted Jun. 30, 1992, and entitled "Drive Mechanism for a Reciprocating Floor Conveyor."

Valves 30, 32 are "pull" type sequencing valves. They function like valves LV4, LV5, LV6 disclosed in my U.S. Pat. No. 5,193,661, granted Mar. 16, 1993. Valves 30, 32 are a valve type that is disclosed in my copending application Ser. No. 07/967,752, filed Oct. 28, 1992, and entitled "Check Valve Pull Assembly."

In preferred form, the drive units include an end of stroke cushion that is disclosed in my copending application Ser. No. 08/054,531, filed on even date herewith, and entitled "End of Stroke Cushion for a Linear Hydraulic Motor."

The above-identified patents and applications are hereby incorporated herein by this specific reference.

Figure 2:
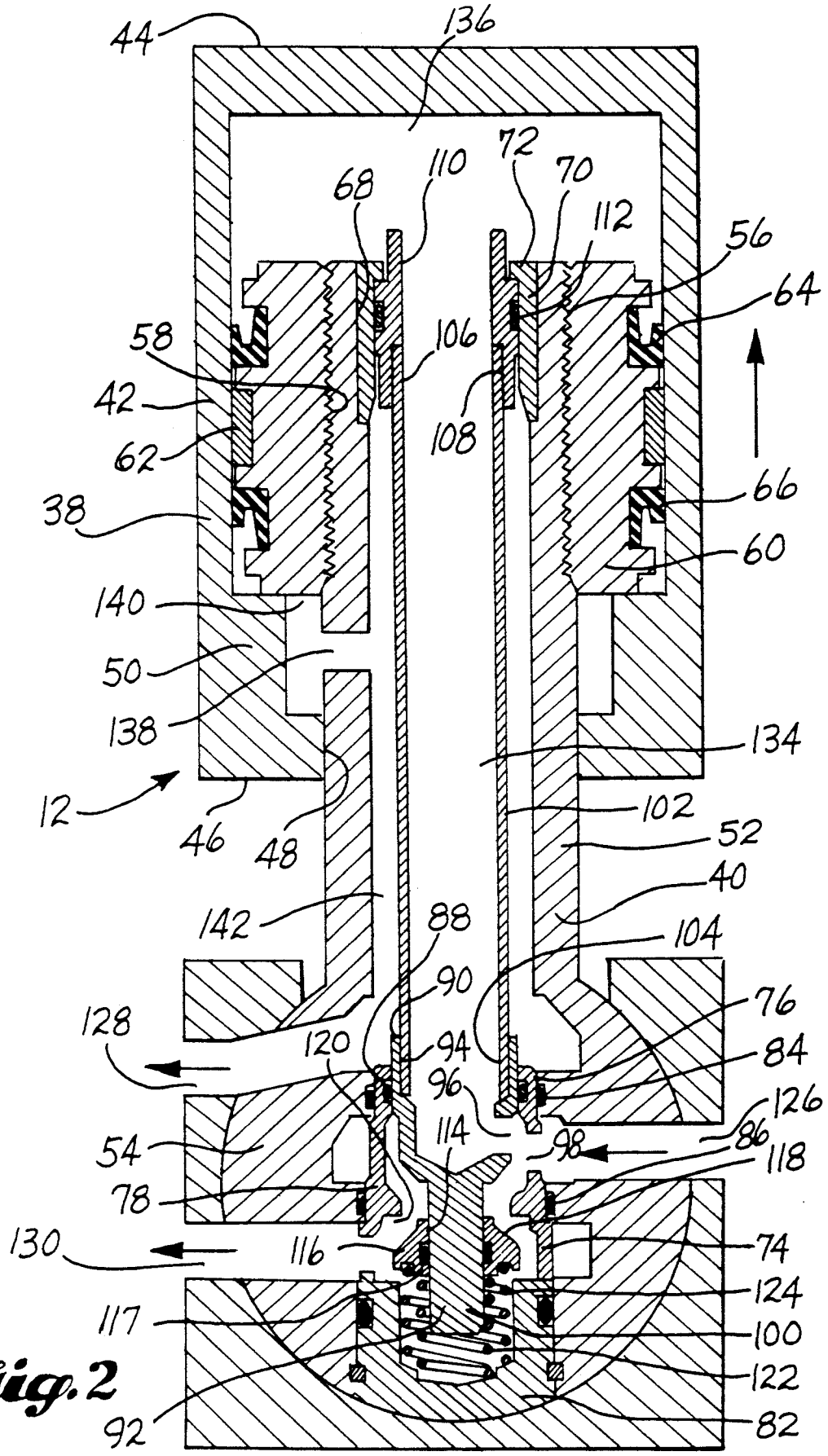
FIG. 2 is a longitudinal sectional view of one of the hydraulic motors, such view showing fluid introduction into a working chamber between the piston head and the closed end of the cylinder body, and fluid pressure acting on a check valve that is in a bypass passageway, to open the check valve and allow some fluid pressure flow through the passageway.
Figure 3:
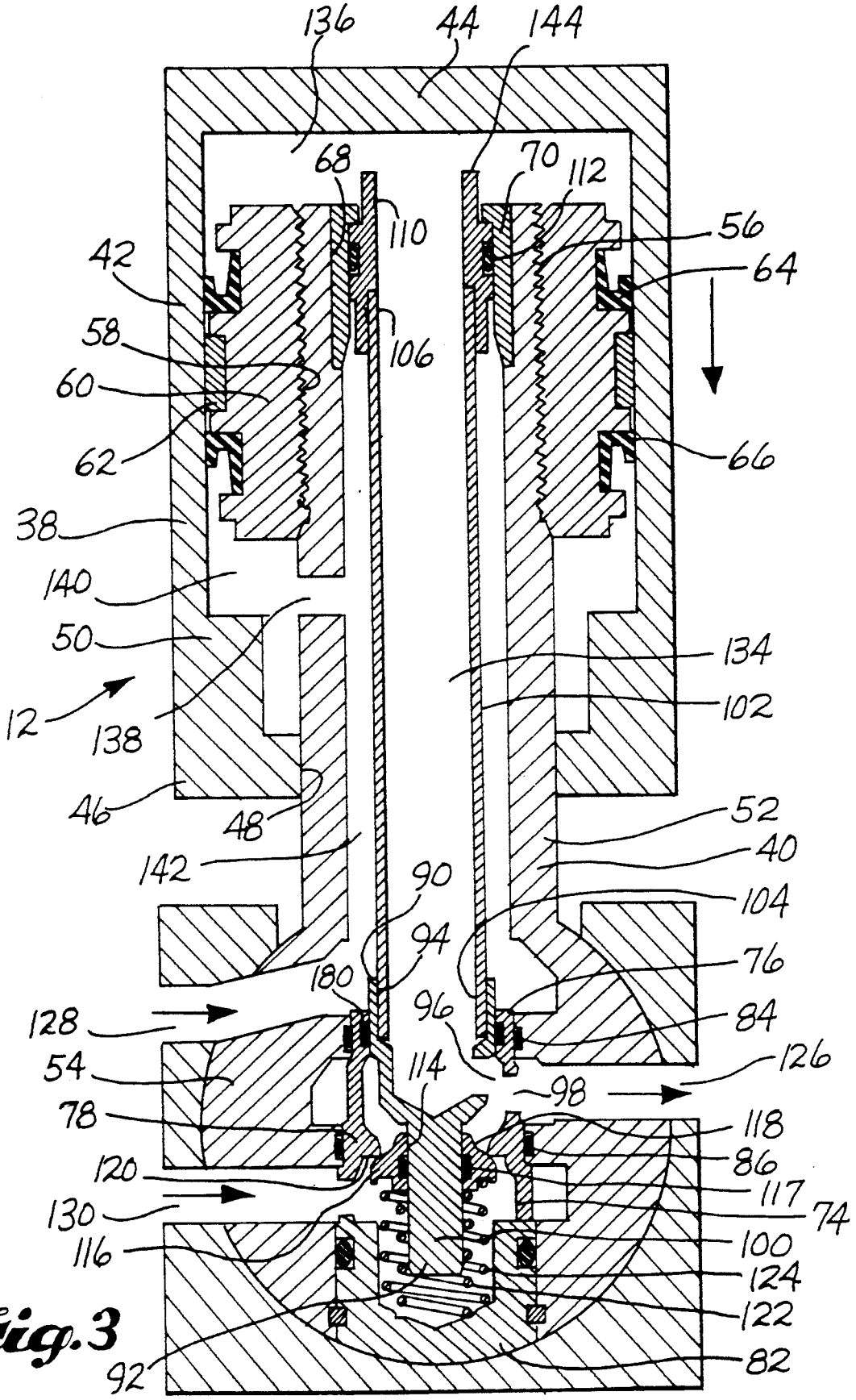
FIG. 3 is a view like FIG. 2, but showing pressure and return reversed and showing the check valve closed to block flow through the bypass passageway.
Figure 4:
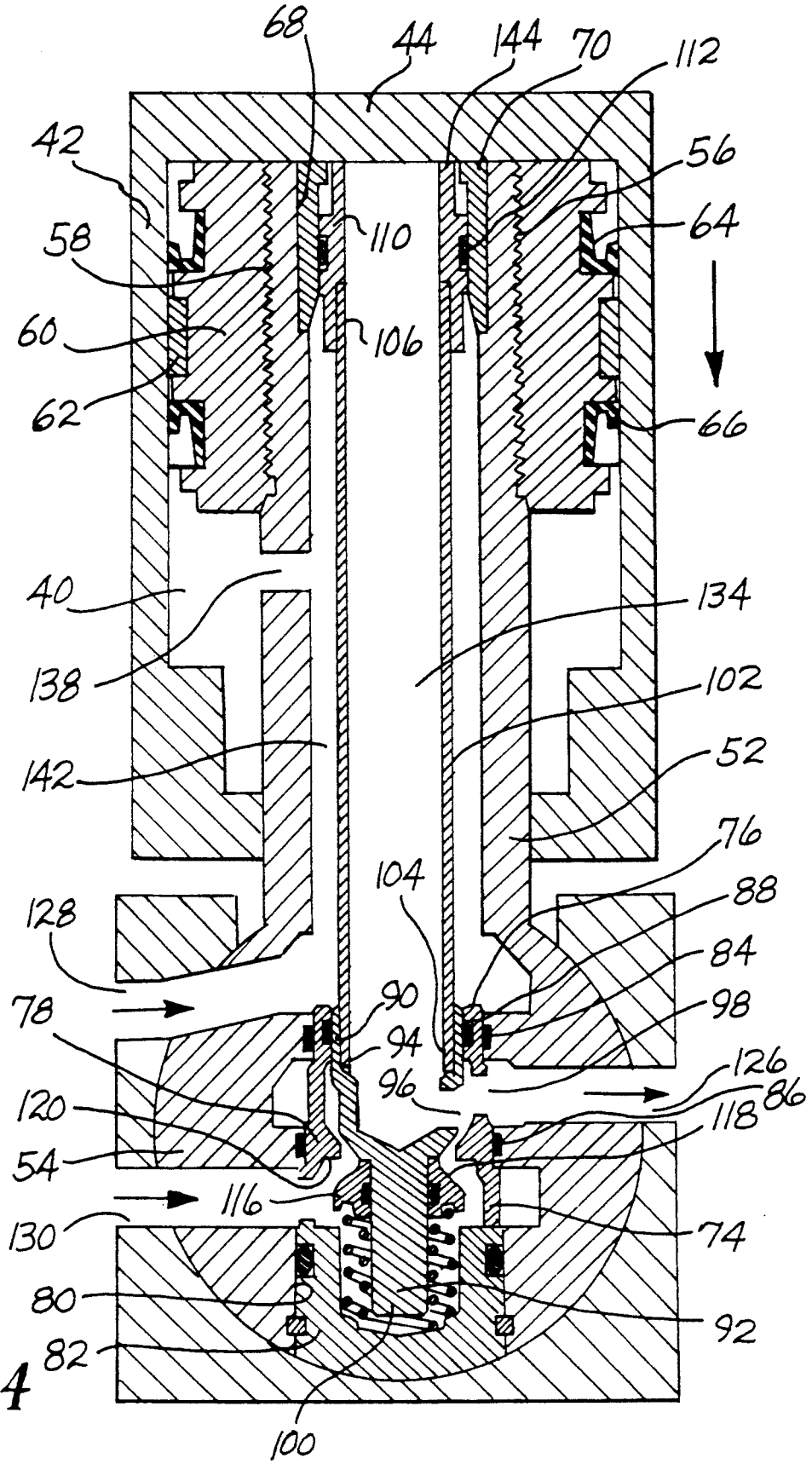
FIG. 4 is a view like FIGS. 2 and 3, showing the pressure and return connection of FIG. 3, but also showing the check valve mechanically opened and flow occurring through the bypass passageway in a direction opposite to the direction shown in FIG. 2.

FIGS. 2–4 illustrate different positions and conditions of drive unit 12. Drive unit 14 is essentially identical so it is not separately described. Drive unit 12 includes a sequencing valve 34 and drive unit 14 includes an identical sequencing valve 36. Drive unit 10 does not include a sequencing valve.

Referring to FIGS. 2–4, drive unit 12 is composed of a cylinder body component 38 and a piston component 40. Cylinder body 38 has a tubular sidewall 42, a closed end wall 44 and an opposite end 46 which includes a center opening 48.

The construction of the cylinder body 38 is not a part of the invention. For that reason, the cylinder head is designated generally at 50. In actual practice, the cylinder head and its arrangement with respect to and its attachment to the cylinder body are as disclosed in the aforementioned application Ser. No. 08/054,531, filed on even date herewith, and entitled "End of Stroke Cushion for a Linear Hydraulic Motor." The piston component 40 includes a tubular piston rod 52 having a mounting ball 54 at one end. The opposite end of piston rod 52 is threaded at 56. Threads 56 engage threads 58 which are on the sidewall of a center passageway in piston head 60. Piston head 60 preferably includes a wear ring 62, of a suitable hard material, and a pair of seal rings 64, 66. The head end of piston rod 52 includes a socket 68 in which a retainer 70 is received. Retainer 70 includes a flange 72. At the ball end, the piston rod 52 includes an insert 74. Insert 74 has a small end 76 and a large end 78. Ball 54 includes an axial opening 80 in its end opposite rod 52. The member 74 is fit into this opening 80. Then a plug 82 is installed. Seal rings 84, 86 are provided between ball 54 and insert 74. A seal ring 88 is provided between insert 74 and a first end portion 90 of an end piece 92. End portion 90 is cup shaped and includes a socket 94 and a side opening 96. Insert 74 includes a side opening 98. The second end 100 of end piece 92 is cylindrical and preferably solid. A center tube 102 is located within piston rod 52. A first end portion 104 of tube 102 fits within socket 94. The opposite end 106 fits within a socket 108 that is a part of a tubular end piece 110. A seal 112 seals between end piece 110 and retainer 70. End portion 100 of member 92 fits through a central opening 114 in a valve plug member 116. A seal 117 seals between valve plug 116 and member 100. Valve plug 116 includes a generally conical closure surface 118 that confronts a valve seat 120. Endwise of valve plug 116 the end member 100 extends into a spring 122 that is surrounded by a spring 124. Springs 122, 124 normally bias plug 116 into a seated position with closure surface 118 against seat 120 (FIG. 3). Tube 102 and the end members 100, 110 are movable as an assembly between the position shown in FIG. 2 and the position shown in FIG. 4.

Referring to FIG. 2, during one phase of operation, port 126 is connected to pressure and port 128 is connected to return. Port 130 leads to port 132 in drive unit 10. Oil under pressure introduced into port 126 flows into a central passageway 134 in center tube 102. This oil moves into a first working chamber 136 that is defined between the piston head 60 and the end wall 44 of the cylinder body 38. One or more sidewall openings 138 in the piston rod 52 connect a second working chamber 140 with an annular passageway 142 that is defined radially between center tube 102 and tubular piston rod 52. Passageway 142 communicates with port 128. Thus, oil introduction through port 126, then port 98, then port 96, and then passageway 134 flows into working chamber 136 and causes working chamber 136 to expand. Working chamber 140 is connected to return via port(s) 138, passageway 142 and port 128. Thus, as working chamber 136 expands, working chamber 140 contracts. Oil pressure entering through port 126 also exerts itself on plug 116, moving plug 116 against springs 122, 124. This moves valve plug 116 away from valve seat 120, creating a flow path between valve seat 120 and closure surface 118. Oil under pressure moves through orifice 98 and then in the passageway between valve seat 120 and closure surface 118, and on to port 130. Thus, when port 126 is connected to pressure and port 130 is connected to return, the valve plug 116 opens in response to line pressure; it acts as a check valve.

At a time when drive unit 12 is fully extended, pressure is connected to port 128 and port 126 is connected to return. The oil entering port 128 moves through passageway 142, and then through port(s) 138 into working chamber 140. The hydraulic oil in working chamber 136 is connected via passageway 134, port 96 and port 98 to port 126 which in turn is connected to return. As a result, oil moves into working chamber 140, working chamber 140 expands, oil moves out of working chamber 136, and working chamber 136 contracts. When this happens, springs 122, 124 move valve plug 116 towards valve seat 120 and seat the closure surface 118 against the valve seat 120 (FIG. 3). Oil entering through port 130 is blocked by the valve plug 116 from flowing from port 130 to port 126. Thus, valve 116, 122, 124 again acts as a check valve and prevents flow in the reverse direction from the direction shown in FIG. 2.

Valve plug 116 stays seated with its closure surface 118 against valve seat 120 until shortly before the end 144 of end member 110 contacts end wall 44. As shown by FIG. 4, following contact, further movement of end wall 44 towards piston head 60 provides a "push" on the end 144 of the center tube assembly. The center tube assembly is mechanically displaced against the springs 122, 124. The springs 122, 124 are compressed and the valve plug 116 is moved mechanically away from the valve seat 120. This opens the passageway between closure surface 118 and valve seat 120. As shown in FIG. 4, oil under pressure is now free to move from port 130 to port 126 via the open passageway between closure surface 118 and valve seat 120.

With respect to function, the internal valve composed of the center tube assembly 100, 102, 110, the valve plug 116, the valve seat 120 and springs 122, 124 performs the function of sequence valves 138, 140 in my aforementioned U.S. Pat. No. 4,748,893 and it also performs the function of my valve assembly 90, 92, 94, 96, 104, 108 and 110 disclosed in my U.S. Pat. No. 4,712,467, granted Dec. 15, 1987.

Figure 5:
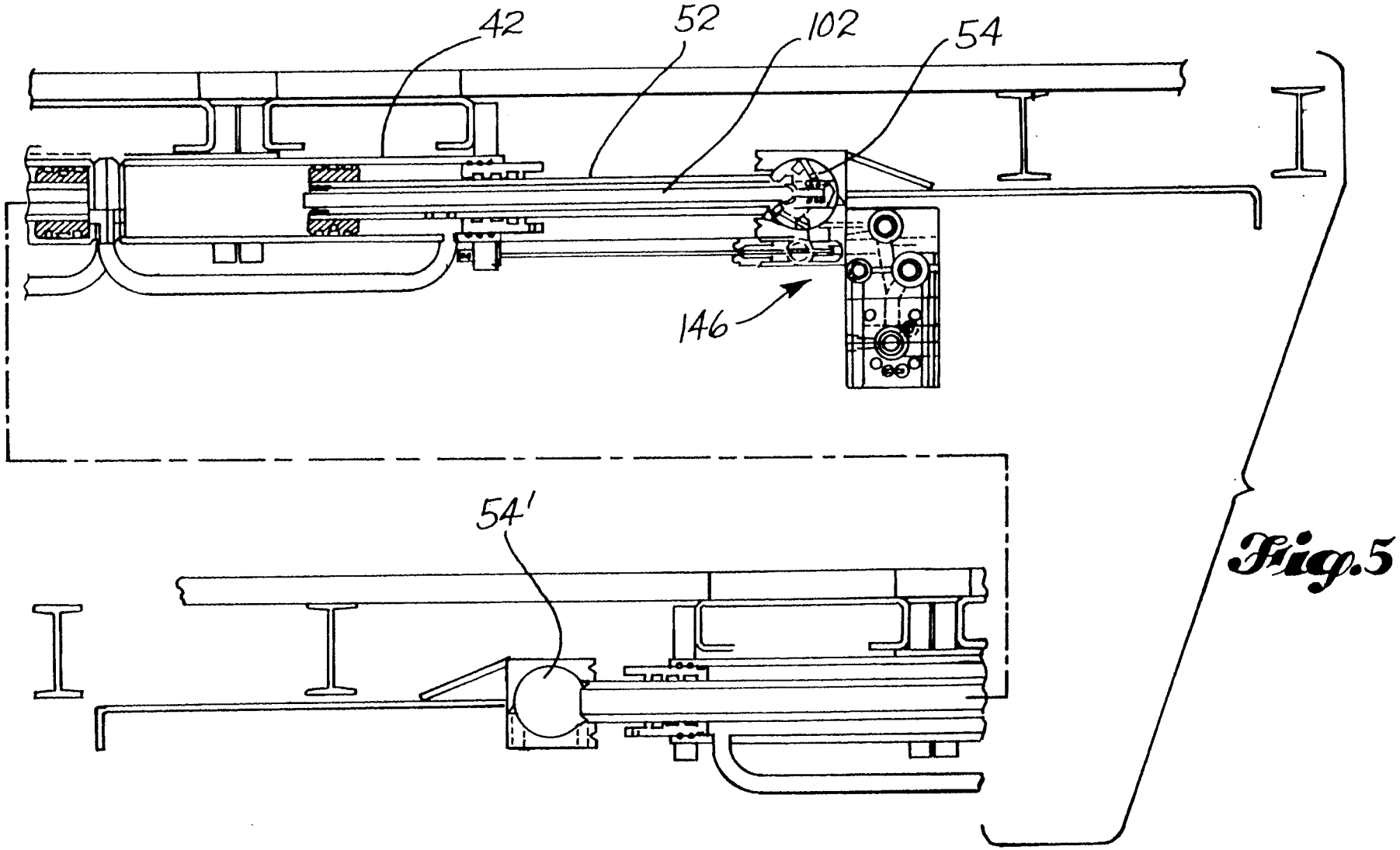
FIG. 5 is a longitudinal sectional view, with some parts in elevation, of a modified form of a piston-cylinder unit.

FIG. 5 discloses a drive unit construction similar to what is shown in my U.S. Pat. Nos. 4,712,467 and 4,748,893. However, there is a mounting ball 54, 54' at each end of the drive unit. Also, fluid is introduced and removed through one end 146 of the drive unit. The drive unit shown by FIG. 5 includes an internal sequencing valve of the type which has just been described in connection with FIGS. 2–4. For that reason, this valve will not again be described. The mounting ball which includes the ports is like mounting ball 54 and so it will not be described. The drive units can be controlled by a system of the type shown by FIG. 1. Therefore, the system will not independently be described. The disclosure of U.S. Pat. No. 4,712,467 is incorporated herein by this specific reference.

The illustrated embodiment is an example of the invention. It is to be understood that variations in form, without variation in substance, can be made without departing from the spirit and scope of the invention. Therefore, the scope of protection is not to be determined by the illustrated embodiment, but rather by the claims which follow, construed by use of the established rules of patent claim construction, including the use of the doctrine of equivalents and reversal of parts.

What is claimed is:

1. An internal check valve for use in a linear hydraulic motor, comprising:

a piston-cylinder unit including a cylinder body reciprocally slidable on a piston component, said piston component including a tubular piston rod and a piston head defining first and second working chambers within said cylinder body;

said tubular piston rod including a center tube located within the piston rod, said center tube providing a fluid passageway through its center which communicates with the first working chamber, and an annular second passageway being formed by and radially between the piston rod and the center tube, the second passageway providing fluid communication with the second working chamber;

a spring biased check valve positioned within said piston rod and operatively connected with one of said passageways, said spring biased check valve having a valve member displaceable from a valve seat by hydraulic pressure to overcome said spring bias and allow flow in one direction; and wherein said center tube is axially displaceable relative to said piston rod, displacement being effected by end of stroke movement of said cylinder body, and such displacement of said center tube causing displacement of said valve member to mechanically open said spring biased check valve.

2. The internal check valve of claim 1, wherein the piston rod includes a first, a second, and a third port, the first port in fluid communication with the fluid passageway in the center tube and first working chamber, the second port in fluid communication with the annular second passageway and second working chamber, the third port in fluid communication with the first port, wherein the spring biased check valve is adapted to shut off fluid communication between the first and third ports.

3. The internal check valve of claim 2, wherein the center tube includes a first end within the cylinder body and a second end exterior of the cylinder body, the second end including a port in fluid communication with the first port.

4. The internal check valve of claim 3, wherein the valve member of the spring-biased check valve is guided along the second end of the center tube into and out of seating engagement with the valve seat.

5. The internal check valve of claim 4, wherein the second end of the center tube includes a smaller diameter extension that forms a radial shoulder in the second end, the valve member adapted to move slidably on the extension, and the shoulder being engageable with the valve member, upon axial displacement of the center tube by end-of-stroke movement of the cylinder body, to unseat the valve member and permit fluid communication between the first and third ports.

6. The internal check valve of claim 5, wherein the first end of the center tube extends beyond the piston head into the first working chamber when the valve member is seated against the valve seat.

7. The internal check valve of claim 6, wherein hydraulic pressure biases the center tube toward the cylinder body and the first end of the center tube into the first working chamber when the valve member is seated against the valve seat.

8. The internal check valve of claim 7, wherein axial displacement of the center tube caused by end-of-stroke movement of the cylinder body is effected against the force of the spring-biased check valve.

9. The internal check valve of claim 3, wherein the first end of the center tube includes a shoulder and the piston head includes a flange, for providing a stop mechanism that limits axial displacement of the center tube toward the cylinder body.

10. The internal check valve of claim 3, wherein the center tube includes a central tubular portion, a first end member mounted at the first end of the center tube to the central tubular portion, and a second end member mounted at the second end of the center tube to the central tubular portion.

11. The internal check valve of claim 10, wherein the piston rod includes a tubular insert about the second end member, the tubular insert forming the valve seat for the spring biased check valve.

12. The internal check valve of claim 11, wherein the tubular insert seals the first and second ports from each other.

13. The internal check valve of claim 11, wherein the tubular insert includes a small diameter section and a large diameter section forming a shoulder therebetween, and wherein the piston rod forms a shoulder for mating with the shoulder of the tubular insert.

14. The internal check valve of claim 13, wherein the piston rod further includes a plug sealing off an end of the piston rod, the plug securing the tubular insert against the shoulder formed by the piston rod, and the spring biased check valve including a spring seated against the plug for biasing the valve member against the valve seat of the spring biased check valve.

15. The internal check valve of claim 14, wherein the second end member of the center tube extends partially within the spring.

16. The internal check valve of claim 13, wherein the tubular insert includes a port providing fluid communication between the spring biased check valve and the third port.

17. The internal check valve of claim 16, wherein the tubular insert includes a second port providing fluid communication between the spring biased check valve and the first port.

18. The internal check valve of claim 10, wherein the first and second end members of the center tube align the center tube within the tubular piston rod.

19. The internal check valve of claim 10, wherein the first end member of the center tube includes a shoulder and the tubular piston rod includes a flange, the shoulder and flange adapted to mate and stop axial displacement of the center tube toward the cylinder body.

20. The internal check valve of claim 19, wherein the tubular piston rod includes a socket and a retainer mounted within the socket, one end of the retainer forming the flange for engaging the shoulder of the first end member of the center tube.

21. The internal check valve of claim 20, wherein a seal is provided between the first end member of the center tube and the retainer of the piston rod.

22. The internal check valve of claim 21, wherein the first end member of the center tube includes an annular projection extending from its shoulder so that upon engagement of its shoulder with the flange of the retainer, the annular projection extends beyond the end of the piston rod and is engageable by the cylinder body.

23. The internal check valve of claim 1, wherein the valve member of the spring-biased check valve is biased by a pair of compression springs.

* * * * *